United States Patent [19]

Juzi et al.

[11] Patent Number: 4,681,129

[45] Date of Patent: Jul. 21, 1987

[54] APPARATUS FOR UNIFORMLY DISTRIBUTING A TWO-PHASE MIXTURE

[75] Inventors: Heinz Juzi, Andelfingen; Marco L. Bernasconi, Lustmuhle, both of Switzerland

[73] Assignee: Sulzer Brothers Limited, Winterthur, Switzerland

[21] Appl. No.: 766,931

[22] Filed: Aug. 19, 1985

[30] Foreign Application Priority Data

Aug. 24, 1984 [CH] Switzerland ..... 4046/84

[51] Int. Cl.[4] ..... B67D 5/54

[52] U.S. Cl. ..... 137/154; 137/561 A; 137/590

[58] Field of Search ..... 137/154, 171, 561 A, 137/561 R, 590; 261/22, 23 R, DIG. 75

[56] References Cited

U.S. PATENT DOCUMENTS 266,680 10/1882 Doolittle ..... 137/883
1,181,910 5/1916 McGilvray ..... 137/171
2,193,696 3/1940 Ramsaur ..... 137/561 A
3,636,976 1/1972 Hansel ..... 137/590

FOREIGN PATENT DOCUMENTS 219260 5/1942 Switzerland ..... 137/561 A

*Primary Examiner*—Alan Cohan
*Assistant Examiner*—John A. Rivell
*Attorney, Agent, or Firm*—Kenyon & Kenyon

[57] ABSTRACT

The distribution apparatus is provided with a receptacle to which at least one supply line and at least one discharge line for a two-phase mixture are connected. A level which separates the liquid phase from the gas phase forms in the receptacle and may vary between a very low level and a very high level. The horizontal dimension of the orifice cross-section of the discharge line, as considered over its vertical extend from the lowest level to the highest level, is either as great as on the lowest level or decreases upwardly from the lowest level. The distribution of the two phases of the mixture in the discharge line is substantially always uniform despite substantial changes in level.

15 Claims, 8 Drawing Figures

APPARATUS FOR UNIFORMLY DISTRIBUTING A TWO-PHASE MIXTURE

This invention relates to an apparatus for uniformly distributing a two-phase mixture.

As is known, various types of apparatus have been provided for the distribution of a two-phase mixture. For example, it has been known to construct an apparatus with a receptacle in the form of a horizontal tube into which a number of supply lines and a number of discharge lines extend with the discharge lines being equal to or greater in number than the supply lines. The purpose of such an apparatus is to distribute two-phases of the mixture uniformly to each discharge line so that the phase components are equal and remain constant at constant operating conditions, irrespective of whether the mixture, as supplied in the discrete supply lines has different phase components and/or whether the phase components in the supply lines are subject to variations in time. A uniform distribution has been achieved as follows.

First, the velocity of the entering mixture decreases to a relatively low value in the relatively large space in the receptacle. The flow thus settles down and the two-phases of the mixture separate, mainly because of the difference in specific weight between the two phases.

Second, the surface of the relatively still liquid phase is at a level intersecting an orifice of each discharge line. Since the gas phase issuing from the receptacle flows faster in the orifice than the tougher and denser liquid phase, the liquid phase is, to some extent, entrained by the gas phase. In other words, the orifice of the discharge line operates in about the same way as an injector pump. If the level stays constant and if the pressure conditions inside the receptacle and the discharge line stay constant, the quantity of liquid issuing from the receptacle is constant and can be predetermined by an appropriate design of the components of the apparatus. Consequently, the phase components of the mixture leaving the receptacle can be controlled and maintained constant even when the number of supply lines is different from the number of discharge lines.

However, the known apparatus has been very sensitive to changes in level. Changes of this kind may often occur in operation because of alterations of operating conditions and because of vibration and/or surges acting on the receptacle. If the liquid-phase component is small, the component must be discharged from the receptacle in small quantities. Further, this small quantity must be present in the discharge lines in distributed form in the relatively large quantity of the gas phase. This requirement becomes all the more difficult to comply with in proportion as the number of discharge lines is greater. On the other hand, if the liquid phase component is substantial, the component must reach the discharge lines in a form which can be distributed in an adequate quantity in the gas phase. However, it has been found that the known apparatus cannot adapt to uniform distribution requirements when substantial and rapid changes in level occur.

Of note, it has been known that an apparatus of the above kind has been used, for example, in fossile fuel fired steam generators having a combustion chamber in the form of walls with vertical tubing through which water which is to be evaporated flows upwardly. Alterations in operating conditions cause alterations in the proportions of liquid phase and gas phase in the vapor/- water mixture leaving the combustion chamber walls. Further, since heat distribution in the combustion chamber is not uniform, the take-up of heat by the water in the individual tubes of the walls varies. As a result, there are further changes in the phase components of the mixture of water and vapor issuing from the tubes.

Accordingly, it is an object of the invention to provide an apparatus which is able to uniformly distribute a two-phase mixture in a simple low cost manner.

It is another object of the invention to reduce variations in the liquid-phase and gas-phase components of a mixture from an ideal value despite considerable changes in the level of the mixture within a distribution apparatus.

Briefly, the invention provides an apparatus for uniformly distributing a two-phase mixture which is comprised of a receptacle, at least one supply line which communicates with the receptacle to deliver a two-phase mixture therein and at least one discharge line which communicates with the receptacle to discharge a uniform mixture of the two-phase mixture therefrom. In addition, the discharge line extends into the receptacle and has at least one inlet orifice within the receptacle for passage of a uniform mixture of the two-phase mixture into the discharge line. In accordance with the invention, this orifice has a vertically disposed component and is of a horizontal width at a lowest level thereof which is at least equal to the horizontal width of the remainder of the orifice. That is, the horizontal dimension of the orifice cross-section, as considered over its vertical extent, is at most as great from the lowest level to the highest level as on the lowest level.

Because of the shape of the orifice cross-section of the discharge line, when the liquid level of a gas/liquid mixture in the receptacle rises, the quantity of liquid entrained into the line increases faster than in previously known constructions with the proportion of liquid phase in the mixture supplied to the receptacle. Consequently, despite considerable variations in level, the two phases are always distributed uniformly in the mixture discharging from the receptacle.

A further advantage of the apparatus is that the orifice cross-section can be used for existing equipment with the receptacle being adapted in corresponding manner in the zone of the discharge line.

The effect of the apparatus can be improved further if the horizontal dimension of the orifice cross-section, starting from the lowest level decreases upwardly with the decrease being continuous or stepwise.

These and other embodiments of the invention will become more apparent from the following detailed description taken in conjunction with the accompanying drawings wherein.

Figure 1:
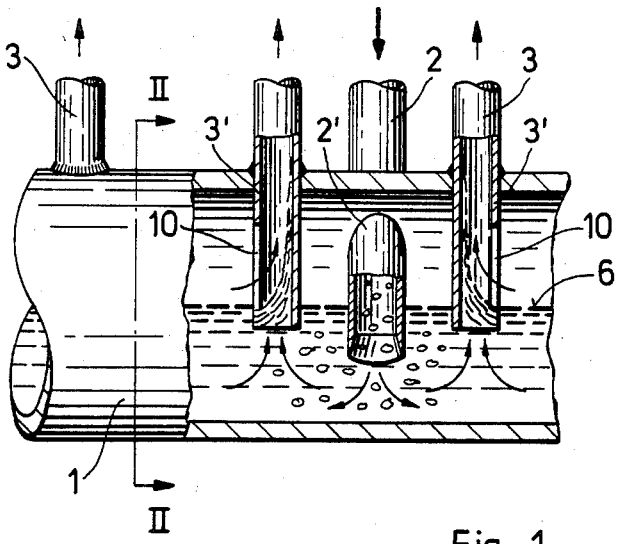
FIG. 1 illustrates a partly elevational and partly sectional view of an apparatus constructed in accordance with the invention.
Figure 2:
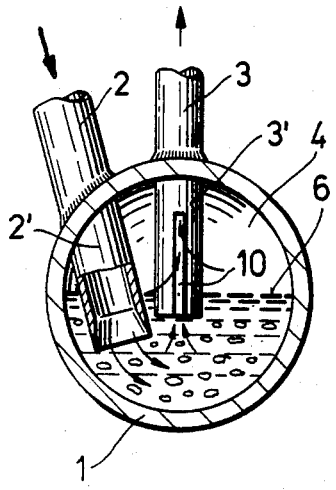
FIG. 2 illustrates a view taken on line II—II of FIG. 1.

Referring to FIGS. 1 and 2, the apparatus for uniformly distributing a two-phase mixture includes a tubular receptacle 1 which is horizontally disposed along a longitudinal axis. In addition, a plurality of supply lines 2 communicates with the receptacle 1 in order to deliver a two-phase mixture therein while a plurality of discharge lines 3 communicate with the receptacle 1 to discharge a uniform mixture of the two-phase mixture therefrom. As indicated in FIG. 1 a pair of discharge lines 3 is provided for each supply line 2.

The receptacle 1 is disposed to receive the two-phase mixture with an interphase level 6 forming between the phases of the mixture. For example, the mixture may be made of a liquid and a gas or vapor.

The lines 2, 3 extend in the form of circular-section tubes downwardly into the receptacle 1 to below the level 6 and particularly below the lowest operating level 6. As indicated in FIG. 1, the discharge lines 3 are of smaller internal diameter than the supply lines 2.

The receptacle 1 is also closed at each end by means of a disc 4 which is secured in place in sealed manner, for example by welds (not shown).

Each discharge line 3 has a depending portion 3' which is formed with at least one inlet orifice in the form of a slot 10. As indicated in FIG. 1, the slot 10 is disposed on a side of the line 3 which is distal from a depending portion 2' of the adjacent supply line 2 and which extends lengthwise of the portion 3'. As indicated in FIG. 2, each slot 10 is vertically disposed and has a horizontal width which is constant in the upwards direction since the vertical limiting edges are parallel.

The receptacle 1 and the line portions 2', 3' extending into the receptacle 1 are so formed that the ends of the portions 2', 3' dip into the liquid phase below the operating level 6 with at least twenty percent (20%) of the length of the slots 10 being wetted by the liquid phase even at the lowest operating level. At the highest operating level, a small part of each slot 10 still remains open.

The discharge lines 3 are disposed substantially vertically near the receptacle 1 while the supply lines 2 are at an inclination to the vertical but at right angles to the axis of the receptacle 1. The lines 2, 3 are sealingly welded to the receptacle 1 at places where each line extends therethrough.

When the apparatus is in operation, a two-phase mixture, for example, of vapor and water, flows through the supply lines 2 into the receptacle 1 and is distributed in the relatively large space of the receptacle 1. This entering mixture thus undergoes a substantial reduction in speed so that the two-phases separate from each other, particularly under gravity so that an operating interphase level 6 forms. Because of the lower pressure in the discharge lines 3, the liquid phase and gas phase flow through the slots 10 in accordance with the behavior discussed above. Hence, since the same operative conditions exist in all the discharge lines 3 and since the discharge lines 3 all have the same dimensions, the quantity ratio of gas or vapor to liquid in the discharge mixture is substantially identical in all the discharge lines 3.

When the quantity relationship in the mixture supplied to the receptacle 1 or the level 6 changes, the quantity relationship between the gas or vapor and the liquid in the discharging mixture alters correspondingly with only minor variations from the ideal distribution for every operating level 6. Of note, minor brief level variations have no appreciable effect on this relationship.

Figure 3:
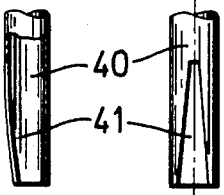
FIG. 3 illustrates a view taken on line III—III of FIG. 4 of a discharge line constructed in accordance with the invention.
Figure 4:
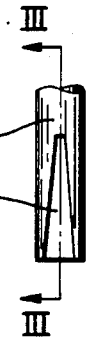
FIG. 4 illustrates a front view of the orifice in the discharge line of FIG. 3.

Referring to FIGS. 3 and 4, the depending portion 40 of a discharge line may be made with a slot 41 of trapezoidal contour, that is, with a constantly decreasing width in a vertically upward direction. To this end, the depending portion 40 may have a slightly curved cut surface which extends downwardly through the axis of the portion 40 as indicated in FIG. 3.

Figure 5:
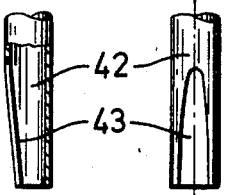
FIG. 5 illustrates a view taken on line V—V of FIG. 6 of a modified discharge line.
Figure 6:
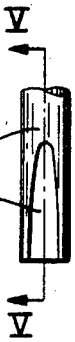
FIG. 6 illustrates a front view of the orifice cross-section of the discharge line of FIG. 5 in accordance with the invention.

Referring to FIGS. 5 and 6, the depending portion 42 of a discharge line may be provided with a slot 43 which is formed by a plane cut surface which extends downwardly towards the axis of the depending portion 42 so that the slot appears as a semi-ellipse in front view.

In the embodiment of FIGS. 3 and 4, the decrease in the horizontal dimension of the slot cross-section decreases faster when the liquid level rises in the receptacle than in the embodiment of FIGS. 5 and 6.

Figure 7:
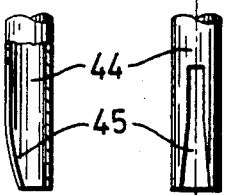
FIG. 7 illustrates a view taken on line VII—VII of FIG. 8 of a further modified discharge line.
Figure 8:
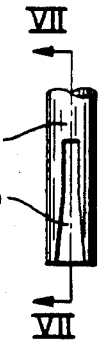
FIG. 8 illustrates a front view of the orifice of the discharge line of FIG. 7.

Referring to FIGS. 7 and 8, the depending portion 44 of a discharge line may be provided with a slot 45 having an upper portion of constant width (as in FIG. 2) and a lower portion of decreasing width in a vertically upward direction (as in FIG. 4). It has been found that this shape of the slot 45 helps to provide an appropriately rapid increase in the discharge component of the liquid phase upon a changeover from the lowest level to the highest level. This slot shape is adequately insensitive to level variations.

As alternative constructions, the supply and discharge line may include angles other than 90° with the length of the receptacle or can be curved. Further, the supply lines may be connected to the side of the receptacle or to the underside of the receptacle. Also, the receptacle may have a shape other than a circular cylinder.

The supply and/or discharge lines may also be closed at the ends extending into the receptacle 1 so that the inlet orifices are disposed only in the generated surface of the particular tube portion concerned. Further, the inlet orifices may have shapes other than those illustrated, for example taking the shape of a helical slot. In another embodiment, each depending discharge tube portion may be formed with two or more slots which are flowed through in parallel.

The invention thus provides a relatively simple apparatus for the uniform distribution of a two-phase mixture.

Further, the invention provides an apparatus which can be employed in existing equipment.

What is claimed is:

1. An apparatus for uniformly distributing a two-phase mixture comprising a receptacle;

at least one supply line communicating with said receptacle to deliver a two-phase mixture of liquid and gas therein with an interphase level forming between the phases; and at least one discharge line communicating with said receptacle to discharge a uniform mixture of the two-phase mixture therefrom, said discharge line extending into said receptacle and having at least one inlet orifice within said receptacle extending through said interphase level for passage of the uniform mixture of the two-phase mixture into said discharge line, said orifice having a vertically disposed component and being of a horizontal width at a lowest level thereof at least equal to the horizontal width of the remainder of said orifice said orifice being wetted by the liquid phase at least at the lowest operating interphase level.

2. An apparatus as set forth in claim 1 wherein said discharge line is vertically disposed within said receptacle.

3. An apparatus as set forth in claim 2 wherein said discharge line is of cylindrical cross-section.

4. An apparatus as set forth in claim 1 wherein said orifice is vertically disposed and is of constant width.

5. An apparatus as set forth in claim 1 wherein said orifice is vertically disposed and of a constantly decreasing width in a vertically upward direction.

6. An apparatus as set forth in claim 1 wherein said orifice has an upper portion of constant width and a lower position of decreasing width in a vertically upward direction.

7. An apparatus as set forth in claim 1 wherein said receptacle is disposed on an elongated horizontal axis.

8. An apparatus as set forth in claim 7 further comprising a plurality of supply lines communicating with said receptacle and a pair of said discharge lines adjacent each supply line, each discharge line having said orifice thereof disposed in distal relation to an adjacent supply line.

9. An apparatus as set forth in claim 1 wherein said orifice is a slot which decreases in width in step-wise manner in an upward direction.

10. An apparatus for uniformly distributing a two phase mixture comprising a horizontally disposed tubular receptacle for receiving a two-phase mixture composed of liquid and gas with an interphase level forming between the phases of the mixture;

a plurality of discharge lines communicating with said receptacle to discharge a uniform mixture of the two-phase mixture therefrom; each said discharge line extending downwardly into said receptacle to below said level and having at least one orifice with a vertically disposed component extending through and below said level for passage of a uniform mixture upwardly through said discharge line, each orifice being wetted by the liquid phase at the lowest operating level and having a horizontal width at a lower end thereof at least equal to the horizontal width of the remainder of said orifice.

11. An apparatus as set forth in claim 10 wherein each discharge line is vertically disposed within said receptacle.

12. An apparatus as set forth in claim 10 wherein said orifice extends below said interphase level with at least twenty percent of the length of said orifice being wetted by the liquid phase at the lowest operating level.

13. An apparatus as set forth in claim 10 wherein said orifice is vertically disposed and is of constant width.

14. An apparatus as set forth in claim 10 wherein said orifice is vertically disposed and of a constantly decreasing width in a vertically upward direction.

15. An apparatus as set forth in claim 10 wherein said orifice has an upper portion of constant width and a lower position of decreasing width in a vertically upward direction.

* * * * *